United States Patent [19]

Riehl

[11] 4,431,240

[45] Feb. 14, 1984

[54] ELECTRICAL IGNITION PROBE MEANS, ELECTRODE THEREFOR AND METHOD OF MAKING THE SAME

[75] Inventor: Fred Riehl, Greensburg, Pa.

[73] Assignee: Robertshaw Controls Company, Richmond, Va.

[21] Appl. No.: 241,202

[22] Filed: Mar. 6, 1981

[51] Int. Cl.[3] ..... H01T 13/04; F23Q 3/00; F23Q 3/70

[52] U.S. Cl. ..... 313/135; 431/264; 361/253; 445/7

[58] Field of Search ..... 313/135; 431/264, 266; 361/253; 445/7; 339/213 S

[56] References Cited

U.S. PATENT DOCUMENTS

| | | | |
|---|---|---|---|
| 1,352,033 | 9/1920 | Sherman et al. | 313/135 X |
| 2,545,945 | 3/1951 | Ensign et al. | 431/266 |
| 2,715,200 | 8/1955 | Flynn | 361/253 |
| 3,073,121 | 1/1963 | Baker et al. | 431/266 X |
| 3,505,568 | 4/1970 | Flynn | 361/253 |
| 4,136,259 | 1/1979 | Djeddah | 445/7 X |
| 4,298,336 | 11/1981 | Riehl | 431/264 |

FOREIGN PATENT DOCUMENTS

| | | | |
|---|---|---|---|
| 2250490 | 10/1970 | Fed. Rep. of Germany | 431/80 |

*Primary Examiner*—Palmer C. Demeo
*Assistant Examiner*—Sandra L. O'Shea
*Attorney, Agent, or Firm*—Candor, Candor & Tassone

[57] ABSTRACT

An electrical ignition probe having an electrode provided with a sparking end and an opposed end interconnected to an end of an ignition wire, the probe having a rigid electrical insulating one-piece body provided with opposed ends interrupted by a bore passing through the body. The body is telescoped on part of the electrode and part of the ignition wire so that the ignition wire extends from one end of the body and the sparking end of the electrode extends from the other end of the body whereby the interconnected ends of the electrode and the ignition wire are disposed in the bore of the body intermediate the ends thereof. The bore in the insulating body is substantially uniform in its cross-sectional configuration and size throughout the entire length of the insulating body.

24 Claims, 6 Drawing Figures

ELECTRICAL IGNITION PROBE MEANS, ELECTRODE THEREFOR AND METHOD OF MAKING THE SAME

BACKGROUND OF THE INVENTION

1. Field of the Invention

This invention relates to an improved electrical ignition probe means for a pilot burner of a fuel burning apparatus, such as a cooking apparatus or the like and to an improved electrode for such a probe means or the like. In addition, this invention relates to improved methods of making such an electrical ignition probe means and/or such an electrode therefor.

2. Prior Art Statement

It is known to provide an electrical ignition probe means having an electrode provided with a sparking end and an opposed end interconnected to an end of an ignition wire, the probe means having a rigid electrically insulating one body provided with opposed ends interrupted by a bore means passing through the body so that the body is telescoped on part of the electrode and part of the ignition wire in such a manner that the ignition wire extends from one of the ends of the body and the sparking end of the electrode extends from the other of the ends of the body whereby the interconnected ends of the electrode and the ignition wire are disposed in the bore means of the insulating body intermediate the ends thereof. The bore means in the insulating body is stepped so that the enlarged portion of the bore means will receive the spliced together ends of the electrode and the ignition wire and the shoulder defined by the stepped bore will prevent the electrode from being pulled out of the insulating body in one direction thereof and the subsequently bent end of the electrode wire that projects out of the other end of the insulating body will prevent the electrode from being pulled out of the other end of the insulating body. For an example of a stepped bore in a one-piece insulating body for an electrical probe means, see the U.S. Pat. No. 4,136,259 to Djeddah.

SUMMARY OF THE INVENTION

It is one feature of this invention to provide an improved electrical ignition means for a pilot burner means or the like of a fuel burning apparatus and to a method of making such an electrical ignition probe means.

In particular, it was found according to the teachings of this invention that the prior known structure and method for insulating the spliced ends of the electrode wire and the ignition wire required an expensive machining operation on the rigid electrically insulating body to accommodate the spliced ends of the ignition wire and electrode wire in a manner to prevent relative movement between the insulating body and the sparking end of the electrode.

However, it was found according to the teachings of this invention that the electrode could be formed in a unique manner to permit the bore means that passes through the opposed ends of the rigid electrically insulating body to be substantially uniform throughout the entire length of the electrically insulating body whereby the overall cost of the resulting electrical ignition probe means of this invention is substantially less than the prior known electrical ignition probe means.

For example, one embodiment of this invention provides an electrical ignition probe means having an electrode provided with a sparking end and an opposed end interconnected to an end of an ignition wire, the probe means having a rigid electrically insulating one-piece body provided with opposed ends interrupted by a bore means passing through the body. The electrically insulating body is telescoped on part of the electrode and part of the ignition wire so that the ignition wire extends from one of the ends of the body and the sparking end of the electrode extends from the other of the ends of the body whereby the interconnected ends of the electrode and the ignition wire are disposed in the bore means of the body intermediate the ends of the body. The bore means in the electrical insulating body is substantially uniform in its cross-sectional configuration and size throughout the entire length of the body.

It is another feature of this invention to provide an improved electrode for an electrical ignition probe means and to provide a method of making such an electrode.

In particular, it has been found according to the teachings of this invention that the electrode can comprise a one-piece stamped metallic member having a substantially tubular body portion provided with opposed ends, the sparking end of the electrode extending from one of the ends of the body portion and the other end of the body portion being adapted to be secured to the adjacent end of the ignition wire of the probe means.

Accordingly, it is an object of this invention to provide an improved electrical ignition probe means having one or more of the novel features of this invention as set forth above or hereinafter shown or described.

Another object of this invention is to provide a method of making such an electrical ignition probe means, the method of this invention having one or more of the novel features of this invention as set forth above or hereinafter shown or described.

Another object of this invention is to provide an improved electrode for an electrical ignition probe means, the electrode of this invention having one or more of the novel features of this invention as set forth above or hereinafter shown or described.

Another object of this invention is to provide a method of making such an electrode, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

BRIEF DESCRIPTION OF THE DRAWINGS

FIG. 1 is a fragmentary side view of the improved electrical ignition probe means of this invention mounted to a pilot burner means of a fuel burning apparatus or the like.

Figure 1:
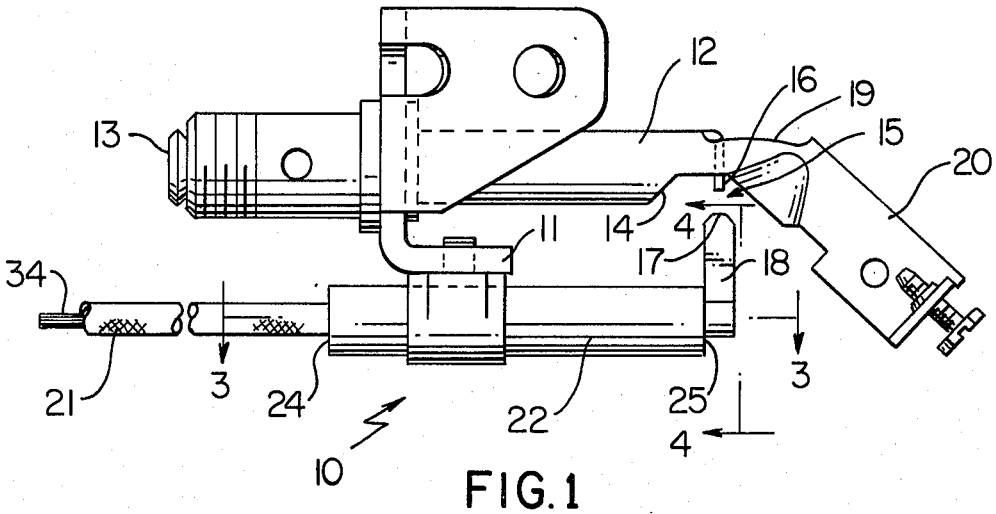
Figure 5:
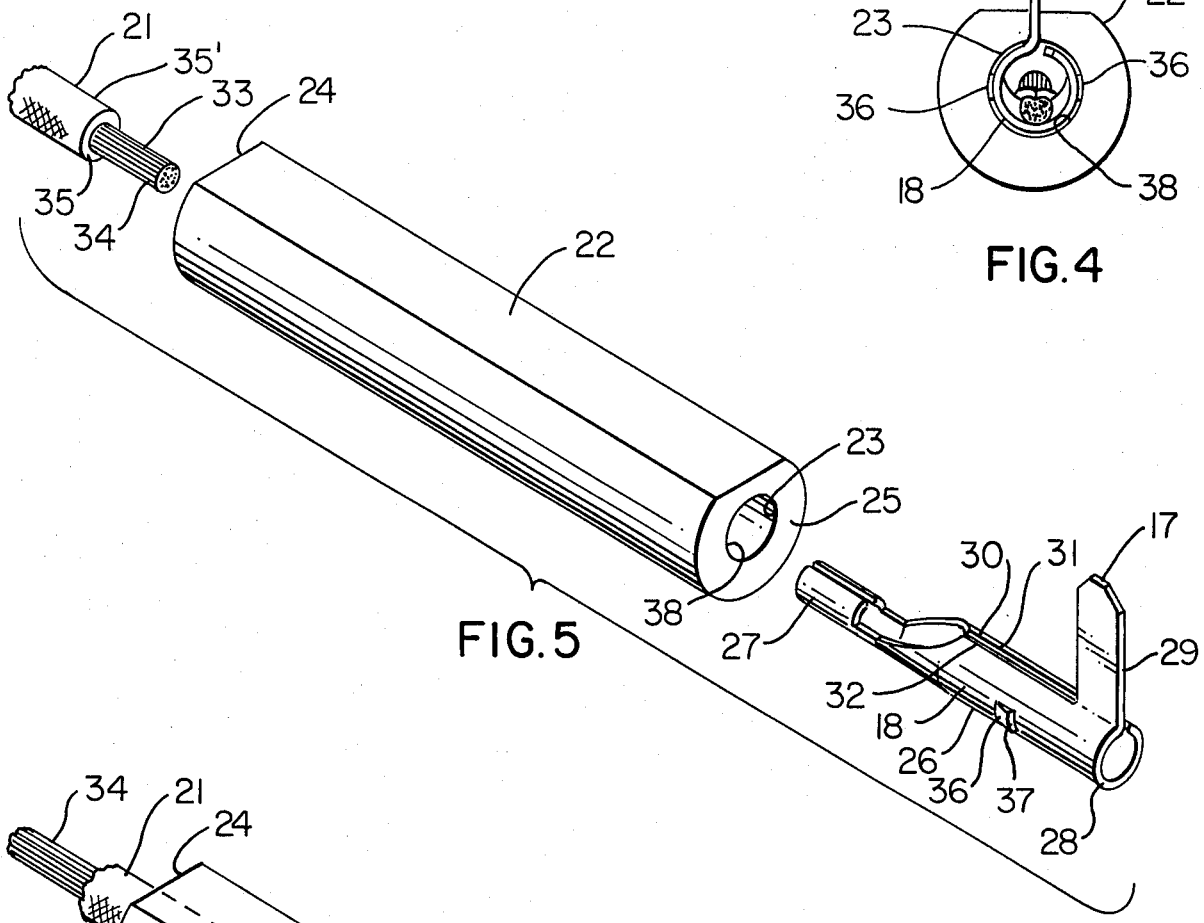
FIG. 5 is an exploded perspective view of the various parts of the electrical ignition probe means of FIG. 1 before the same are assembled together by the method of this invention.
Figure 4:
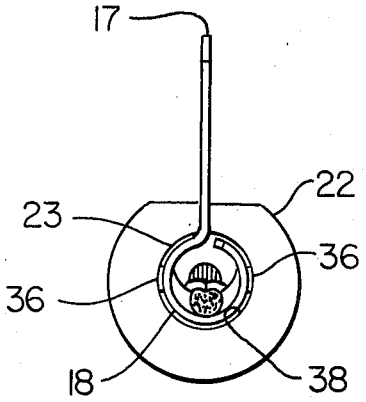
FIG. 4 is an enlarged end view of the electrical ignition probe means of FIG. 1 and is taken in the direction of the arrows 4—4 thereof.
Figure 6:
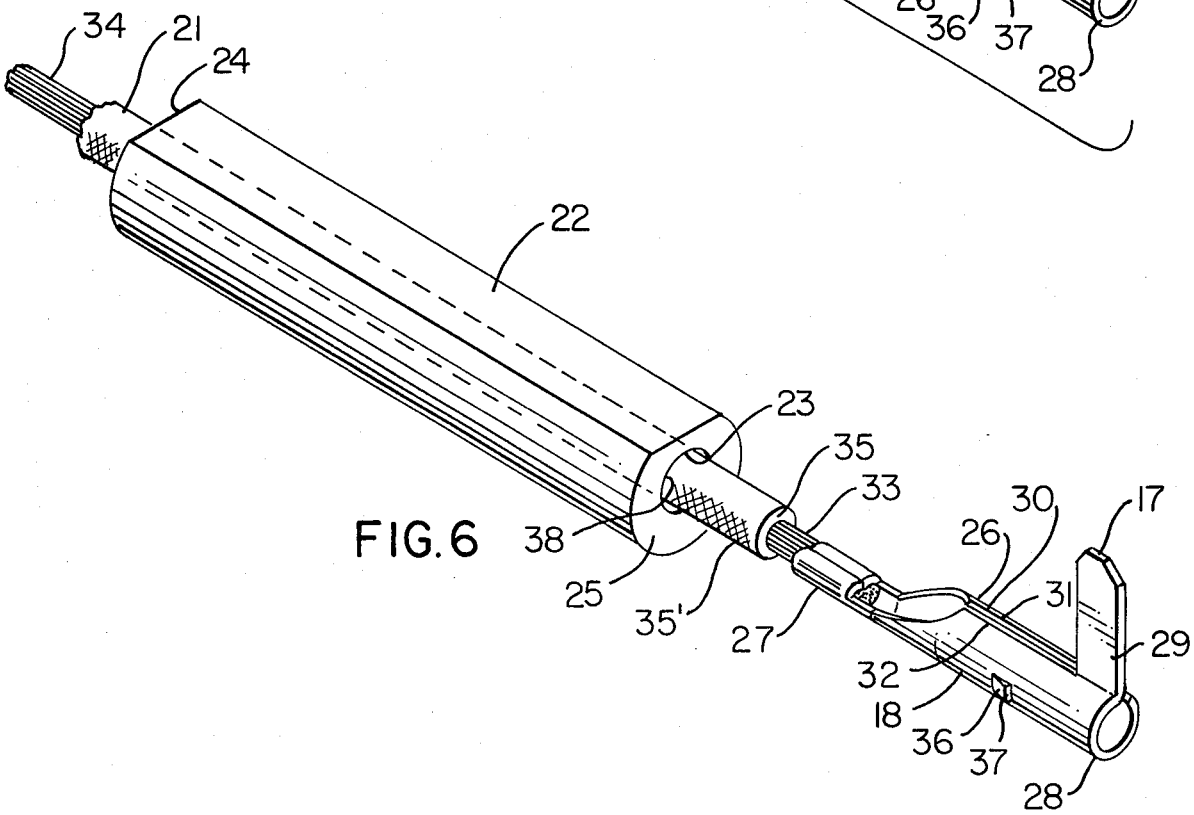

FIG. 6 is a perspective view similar to FIG. 5 and illustrates one of the steps in the method of this invention for making the electrical ignition probe means of FIG. 1.

DESCRIPTION OF THE PREFERRED EMBODIMENT

While the various features of this invention are hereinafter described and illustrated as being particularly adapted to provide an electrical ignition probe means for sparking with a pilot burner means, it is to be understood that the various features of this invention may be utilized singly or in various combinations thereof to provide an electrical ignition probe means for sparking with other devices as desired, such as for directly sparking with a main burner means for direct ignition thereof.

Therefore, this invention is not to be limited to only the embodiment illustrated in the drawings, because the drawings are merely utilized to illustrate one of the wide variety of uses of this invention.

Referring now to FIG. 1, the improved electrical ignition probe means of this invention is generally indicated by the reference numeral 10 and is illustrated as being secured by suitable bracket means 11 to a pilot burner means 12 in a manner fully set forth in the copending patent application, Ser. No. 073,673 filed Sept. 10, 1979, now U.S. Pat. No. 4,298,336, whereby only the details of the pilot burner means 12 necessary to understand this invention need be set forth as the features of this invention are directed to the electrical ignition probe means 10 and not to the particular pilot burner means utilized therewith.

In particular, the pilot burner means 12 illustrated in FIG. 1 has an inlet 13 adapted to be interconnected to a source of fuel and an outlet 14 through which the fuel issues and passes through a spark gap 15 defined between a a diffusion tang 16 of the pilot burner means 12 and a tip 17 of an electrode 18 of the electrical ignition probe means 10 of this invention whereby eletrical sparking is adapted to occur between the probe tip 17 and the diffusion tang 16 of the grounded pilot burner means 12 to ignite the fuel issuing out of the outlet 14 of the pilot burner means 12. The resulting pilot flame can pass out through an opening 19 in a flame shield 20 of the pilot burner means 12 in a manner well known in the art to provide a standing pilot flame.

Once a sufficient flame exists at the outlet 14 of the pilot burner means 12, the flame ionizes the gas in the spark gap 15 so that the sparking between the probe end 17 and the diffusion tang 16 will cease to exist because the ionization of the gas between the probe end 17 and the diffusion tang 16 continuously dissipates a capacitor which originally had the charge buildup to cause the sparking from the probe end 17 so that further sparking of the electrical ignition probe means 10 does not take place as long as the pilot flame exists at the pilot burner 12.

However, should the flame cease, the capacitor of the electrical circuit (not shown) is then permitted to build up its charge in a manner well known in the art to cause a resparking from the end 17 of the probe means 10 to the grounded diffusion tang 16 of the pilot burner means 12 to reignite the issuing fuel.

The details of the electrical ignition probe means 10 of this invention and the method of this invention for making such electrical ignition probe means 10 will now be described and reference is made to FIGS. 2 and 5 wherein it can be seen that the electrical ignition probe means 10 of this invention is formed from the electrode 18, an ignition wire 21 and a rigid electrically insulating body 22.

Figure 2:
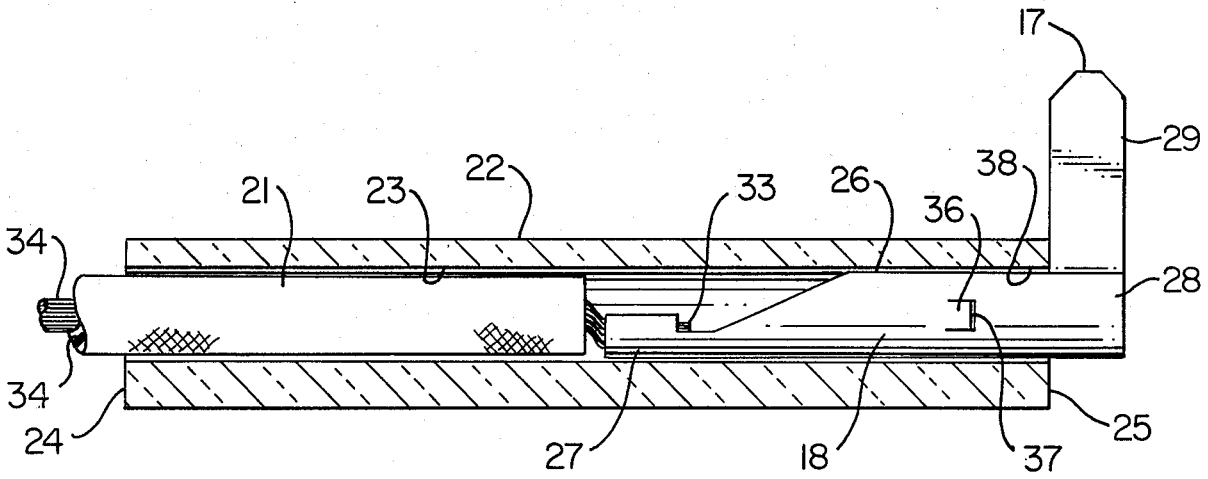
FIG. 2 is an enlarged fragmentary cross-sectional view of the electrical ignition probe means of FIG. 1.
Figure 3:
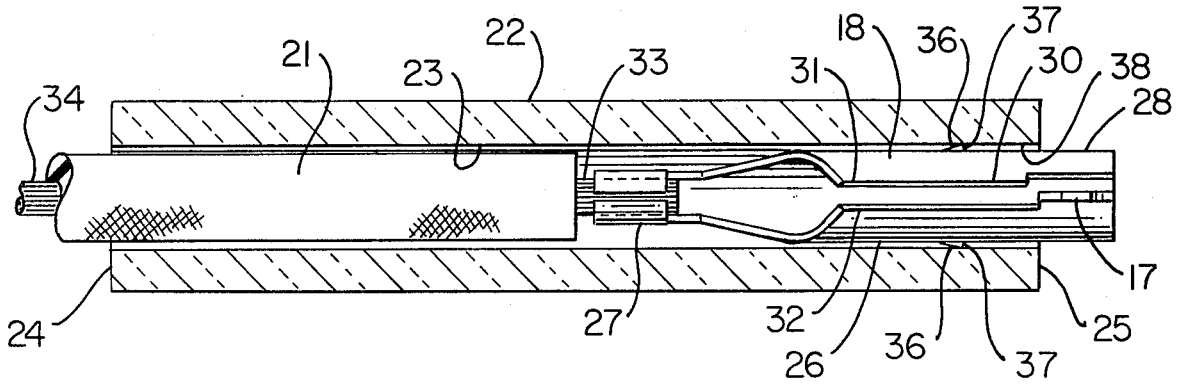
FIG. 3 is an enlarged fragmentary cross-sectional view of the electrical ignition probe means of FIG. 1 and is taken on the line 3—3 thereof.

The electrically insulating body 22 can be formed of ceramic material and has an opening or bore means 23 interrupting and passing through the opposed ends 24 and 25 thereof, the bore means 23 having a substantially uniform and circular cross-sectional configuration throughout the entire length of the body 22 as fully illustrated in FIGS. 2 and 3. In this manner, it has been found that the cost of manufacturing the ceramic body 22 is substantially less than when a stepped bore means or other non-uniform opening is formed through the ceramic body as is provided in the prior known ignition probe means.

One of the reasons why the electrical insulating body 22 of this invention can have the bore means 23 with a uniform cross section throughout the entire length thereof is because of the unique electrode 18 of this invention which through its particular structure will prevent the electrode 18 from being removed from the opening 23 of the body 22 after the same has been assembled therein in a manner hereinafter set forth without requiring a stepped shoulder arrangement in the ceramic body 22 as in the prior known structure.

In particular, the electrode 18 of this invention comprises a one-piece stamped metallic member which has a substantially tubular body portion 26 provided with opposed ends 27 and 28, the sparking end 29 of the electrode 18 being integral with the body portion 26 and extending substantially transversely to the end 28 thereof so as to position the sparking tip 17 vertically above the body portion 26.

Because the electrode 18 comprises a one-piece member cut and stamped from a flat sheet of stock material into the configuration illustrated in FIGS. 5 and 6, it can be seen that, in effect, a slot means 30 extends between the opposed ends 27 and 28 thereof and thereby defines opposed edge means 31 and 32 throughout the length of the body portion 26. In this manner, the sparking end 29 of the electrode 18 is integral with the edge 32 and extends vertically from the same as illustrated in a manner to substantially bisect the tubular body portion 26.

Because of the slot means 30, the tubular end 27 of the body portion 26 is adapted to telescopically receive a bared end 33 of the ignition wire 21 therein in a manner illustrated in FIG. 6 and then be crimped inwardly around the end 33 as illustrated in FIG. 6 to securely secure the ignition wire 21 to the end 27 of the electrode 18.

While the ignition wire 21 can be formed of any suitable material, it has been found that the same can comprise size No. 18 tinned copper wire 34 coated with a silicone rubber 35 and covered with a fray resistant glass braided jacket 35', the length of the ignition wire 21 being of any desired length within suitable limits.

The electrode 18 has a pair of integral tangs or ears 36 formed on opposite sides of the tubular body portion 26 and intermediate the ends 27 and 28 thereof, the ears having sharp free edges 37 which are adapted to engage and dig into the internal peripheral surface 38 of the ceramic body 22 when the electrode 18 is disposed within the opening or bore 23 in the manner illustrated in FIGS. 2 and 3.

In this manner, the ears 36 of the electrode 18 tend to prevent relative movement of the electrode 18 relative to the body 22 after the same has been assembled therein in a manner hereinafter set forth.

Therefore, it can be seen that the parts for forming the electrical ignition probe means 10 of this invention can be formed in a relatively simple manner to form the electrical ignition probe means by the method of this invention in a manner now to be described.

When it is desired to assemble an electrode 18 of this invention to the end 33 of the ignition wire 21, the ceramic body 22 can be telescoped onto the ignition wire 21 so that the end 33 of the ignition wire 21 extends beyond the end 25 thereof in a manner illustrated in FIG. 6 or the body 22 can be disposed on the ignition wire 21 after the electrode 18 has been secured to the end 33 of the ignition wire 21 as desired.

In any event, the insulation 35 and 35' of the ignition wire 21 is removed from one end of the wire 34 to expose the bared end 33 thereof so that the end 33 can be telescoped into the tubular end 27 of the body portion 26 of the electrode 18 and be secured therein by having the end 27 crimped inwardly around the end 33 of the ignition wire 21 in the manner illustrated in FIG. 6 to securely fasten the end 27 of the electrode 18 to the end 33 of the ignition wire 21.

Thereafter, the rigid electrically insulating body 22 and the electrode 18 are telescoped together so that the body portion 26 of the electrode 18 is received in the opening or bore means 23 of the body 22 at the end 25 thereof whereby the angle of the tangs 36 of the electrode 18 permit such relative movement between the body 22 and the electrode 18, such as by pulling on the left-hand end of the ignition wire 21 and/or by pushing on the electrode 18 to force the same into the opening 23 of the body 22 at the end 25 thereof. Such telescoping movement is continued until the upstanding sparking end 29 of the electrode 18 abuts against the end 25 of the ceramic body 22 in the manner illustrated in FIGS. 1 and 2 whereby the electrode 18 is firmly secured in the rigid body 22 and the rigid body 22 fully electrically insulates the spliced connection between the end 27 of the electrode 18 and the end 33 of the ignition wire 21. In particular, the electrode 18 not only cannot be readily pulled out of the opening 23 because of the ends 37 of the tabs 36 biting into the internal peripheral surface 38 of the body 22 to resist such outward movement, but also rotational movement between the electrode 18 and the body 22 is prevented by the tabs 36. Obviously, pulling outwardly to the left on the electrode wire 21 is resisted by the sparking end 29 of the electrode 18 abutting the shoulder 25 of the body 22.

It can be seen in FIGS. 5 and 6 that the rigid body 22 has a flat side which cooperates with a mating portion of the bracket 11 to prevent rotational movement of the ceramic member 22 in the bracket 11 so that if the sparking end 29 of the electrode 18 is properly oriented with the flat surface of the body 22 during the assembling of the electrode 18 into the opening 23 of the body 22, the sparking end 29 will be properly oriented with the diffusion tang 16 of the pilot burner means 12 when the electrical ignition probe means 10 of this invention is subsequently assembled to the pilot burner means 12 by the mounting bracket 11 in the manner set forth in the aforementioned copending application.

Therefore, it can be seen that it is a relatively simple method of this invention to form the electrical ignition probe means 10 of this invention that is adapted to function with the pilot burner means 12 in the manner previously described to cause sparking across the spark gap 15 as defined between the tip 17 of the sparking end 29 of the electrode 18 and the diffusion tang 16 of the pilot burner means 12.

Accordingly, it can be seen that this invention not only provides an improved electrical ignition probe means and a method of making the same, but also this invention provides an improved electrode for such an electrical ignition probe means and a method of making such an electrode.

While the forms and methods of this invention now preferred have been illustrated and described as required by the Patent Statute, it is to be understood that other forms and method steps can be utilized and still fall within the scope of the appended claims.

What is claimed is:

1. In an electrical ignition probe means having an electrode provided with a sparking end and an opposed end interconnected to an end of an ignition wire, said probe means having a rigid electrically insulating one-piece body provided with opposed ends interrupted by a bore means passing through said body, said body being telescoped on part of said electrode and part of said ignition wire so that said ignition wire extends from one of said ends of said body and said sparking end of said electrode extends from the other of said ends of said body whereby said interconnected ends of said electrode and said ignition wire are disposed in said bore means of said body intermediate said ends of said body, the improvement wherein said bore means in said body is substantially uniform in its cross-sectional configuration and size throughout the entire length of said body and is substantially filled by said parts of said ignition wire and said electrode.

2. An electrical ignition probe means as set forth in claim 1 wherein said cross-sectional configuration of said bore means of said body is substantially circular.

3. An electrical ignition probe means as set forth in claim 2 wherein said body is formed of ceramic material.

4. An electrical ignition probe means as set forth in claim 1 wherein said electrode comprises a stamped metallic member.

5. An electrical ignition probe means as set forth in claim 1 wherein said electrode has a substantially tubular body portion provided with opposed ends, said sparking end of said electrode extending from one of said ends of said body portion and being substantially transverse relative thereto.

6. An electrical ignition probe means as set forth in claim 5 wherein said other end of said body portion of said electrode receives said end of said ignition wire therein, said other end of said body portion of said electrode being crimped to said end of said ignition wire to secure the same together.

7. An electrical ignition probe means as set forth in claim 6 wherein said electrode comprises a one-piece metallic member.

8. In an electrical ignition probe means having an electrode provided with a sparking end and an opposed end interconnected to an end of an ignition wire, said probe means having a rigid electrically insulating body provided with opposed ends interrupted by a bore means passing through said body, said body being telescoped on said electrode and said ignition wire so that said ignition wire extends from one of said ends of said body and said sparking end of said electrode extends from the other of said ends of said body whereby said interconnectd ends of said electrode and said ignition wire are disposed in said bore means of said body intermediate said ends of said body, the improvement wherein said bore means in said body is substantially uniform in its cross-sectional configuration throughout the entire length of said body, said electrode having a substantially tubular body portion provided with opposed ends, said sparking end of said electrode extending from one of said ends of said body portion and being substantially transverse relative thereto, said body portion having tang means extending therefrom and engaging said insulating body to prevent relative movement between said insulating body and said electrode.

9. In an electrical ignition probe means having an electrode provided with a sparking end and an opposed end interconnected to an end of an ignition wire, said probe means having a rigid electrically insulating body provided with opposed ends interrupted by a bore means passing through said body, said body being telescoped on said electrode and said ignition wire so that said ignition wire extends from one of said ends of said body and said sparking end of said electrode extends from the other of said ends of said body whereby said interconnected ends of said electrode and said ignition wire are disposed in said bore means of said body intermediate said ends of said body, the improvement wherein said bore means in said body is substantially uniform in its cross-sectional configuration throughout the entire length of said body, said electrode having a substantially tubular body portion provided with opposed ends, said sparking end of said electrode extending from one of said ends of said body portion and being substantially transverse relative thereto, said body portion of said electrode having a slot means extending the entire length thereof and to said ends thereof whereby said body portion has two side-by-side edges defined by said slot means, said sparking end extending from one of said edges.

10. An electrical ignition probe means as set forth in claim 9 wherein said sparking end of said electrode is disposed in abutting relation with said other end of said insulating body.

11. In a method of making an electrical ignition probe means having an electrode provided with a sparking end and an opposed end interconnected to an end of an ignition wire, said probe means having a rigid electrically insulating one-piece body provided with opposed ends interrupted by a bore means passing through said body, said body being telescoped on part of said electrode and part of said ignition wire so that said ignition wire extends from one of said ends of said body and said sparking end of said electrode extends from the other of said ends of said body whereby said interconnected ends of said electrode and said ignition wire are disposed in said bore means of said body intermediate said ends of said body, the improvement comprising the step of forming said bore means in said body to be substantially unform in its cross-sectional configuration and size throughout the entire length of said body and be substantially filled by said parts of said ignition wire and said electrode.

12. A method of making an electrical ignition probe means as set forth in claim 11 and including the step of forming said cross-sectional configuration of said bore means of said body to be substantially circular.

13. A method of making an electrical ignition probe means as set forth in claim 12 and including the step of forming said body from ceramic material.

14. A method of making an electrical ignition probe means as set forth in claim 11 and including the step of stamping said electrode from a metallic member.

15. A method of making an electrical ignition probe means as set forth in claim 11 and including the steps of forming said electrode to have a substantially tubular body portion provided with opposed ends, and forming said sparking end of said electrode to extend from one of said ends of said body portion and be substantially transverse relative thereto.

16. A method of making an electrical ignition probe means as set forth in claim 15 and including the steps of disposing said end of said ignition wire in said other end of said body portion of said electrode, and crimping said other end of said body portion of said electrode to said end of said ignition wire to secure the same together.

17. A method of making an electrical ignition probe means as set forth in claim 16 and including the step of forming said electrode as a one-piece metallic member.

18. In a method of making an electrical ignition probe means having an electrode provided with a sparking end and an opposed end interconnected to an end of an ignition wire, said probe means having a rigid electrically insulating body provided with opposed ends interrupted by a bore means passing through said body, said body being telescoped on said electrode and said ignition wire so that said ignition wire extends from one of said ends of said body and said sparking end of said electrode extends from the other of said ends of said body whereby said interconnected ends of said electrode and said ignition wire are disposed in said bore means of said body intermediate said ends of said body, the improvement comprising the steps of forming said bore means in said body to be substantially uniform in its cross-sectional configuration throughout the entire length of said body, forming said electrode to have a substantially tubular body portion provided with opposed ends, forming said sparking end of said electrode to extend from one of said ends of said body portion and be substantially transverse relative thereto, forming said body portion to have tang means extending therefrom, and engaging said tang means against said insulating body to tend to prevent relative movement between said insulating body and said electrode.

19. In a method of making an electrical ignition probe means having an electrode provided with a sparking end and an opposed end interconnected to an end of an ignition wire, said probe means having a rigid electrically insulating body provided with opposed ends interrupted by a bore means passing through said body, said body being telescoped on said electrode and said ignition wire so that said ignition wire extends from one of said ends of said body and said sparking end of said electrode extends from the other of said ends of said body whereby said interconnected ends of said electrode and said ignition wire are disposed in said bore means of said body intermediate said ends of said body, the improvement comprising the steps of forming said bore means in said body to be substantially uniform in its cross-sectional configuration throughout the entire length of said body, forming said electrode to have a substantially tubular body portion provided with opposed ends, forming said sparking end of said electrode to extend from one of said ends of said body portion and be substantially transverse relative thereto, forming said body portion of said electrode to have a slot means extending the entire length thereof and to said ends thereof whereby said body portion has two side-by-side edges defined by said slot means, and extending said sparking end from one of said edges.

20. A method of making an electrical ignition probe means as set forth in claim 19 and including the step of abutting said sparking end of said electrode against said other end of said insulating body.

21. In an electrode for an electrical ignition probe means, said electrode having a sparking end and an opposed end adapted to be interconnected to an end of an ignition wire whereby a rigid electrically insulating body can be telescoped on said electrode and said ignition wire so that said ignition wire can extend from one end of said body and said sparking end of said electrode can extend from the other end of said body with said interconnected ends of said electrode and said ignition wire being disposed in a bore means of said body intermediate said ends of said body, the improvement wherein said electrode has a substantially tubular body portion provided with opposed ends, said sparking end of said electrode extending from one of said ends of said body portion and being substantially transverse relative thereto, said body portion having tang means extending therefrom and being adapted to engage said insulating body to tend to prevent relative movement between said insulating body and said electrode.

22. In an electrode for an electrical ignition probe means, said electrode having a sparking end and an opposed end adapted to be interconnected to an end of an ignition wire whereby a rigid electrically insulating body can be telescoped on said electrode and said ignition wire so that said ignition wire can extend from one end of said body and said sparking end of said electrode can extend from the other end of said body with said interconnected ends of said electrode and said ignition wire being disposed in a bore means of said body intermediate said ends of said body, the improvement wherein said electrode has a substantially tubular body portion provided with opposed ends, said sparking end of said electrode extending from one of said ends of said body portion and being substantially transverse relative thereto, said body portion of said electrode having a slot means extending the entire length thereof and to said ends thereof whereby said body portion has two side-by-side edges defined by said slot means, said sparking end extending from one of said edges.

23. In a method of making an electrode for an electrical ignition probe means, said electrode having a sparking end and an opposed end adapted to be interconnected to an end of an ignition wire whereby a rigid electrically insulating body can be telescoped on said electrode and said ignition wire so that said ignition wire can extend from one end of said body and said sparking end of said electrode can extend from the other end of said body with said interconnected ends of said electrode and said ignition wire being disposed in a bore means of said body intermediate said ends of said body, the improvement comprising the steps of forming said electrode to have a substantially tubular body portion provided with opposed ends, forming said sparking end of said electrode to extend from one of said ends of said body portion and be substantially transverse relative thereto, and forming said body portion to have tang means extending therefrom and be adapted to engage against said insulating body to tend to prevent relative movement between said insulating body and said electrode.

24. In a method of making an electrode for an electrical ignition probe means, said electrode having a sparking end and an opposed end adapted to be interconnected to an end of an ignition wire whereby a rigid electrically insulating body can be telescoped on said electrode and said ignition wire so that said ignition wire can extend from one end of said body and said sparking end of said electrode can extend from the other end of said body with said interconnected ends of said electrode and said ignition wire being disposed in a bore means of said body intermediate said ends of said body, the improvement comprising the steps of forming said electrode to have a substantially tubular body portion provided with opposed ends, forming said sparking end of said electrode to extend from one of said ends of said body portion and be substantially transverse relative thereto forming said body portion of said electrode to have a slot means extending the entire length thereof and to said ends thereof whereby said body portion has two side-by-side edges defined by said slot means, and extending said sparking end from one of said edges.

* * * * *